US005256057A

United States Patent [19]

Grow

[11] Patent Number: 5,256,057

[45] Date of Patent: Oct. 26, 1993

[54] FUEL CONTROL CIRCUIT

[75] Inventor: Fred Grow, McHenry, Ill.

[73] Assignee: Protection Controls Inc., Skokie, Ill.

[21] Appl. No.: 911,942

[22] Filed: Jul. 10, 1992

[51] Int. Cl.[5] ..... F23N 5/08

[52] U.S. Cl. ..... 431/79; 431/78; 431/25

[58] Field of Search ..... 431/24, 25, 78, 79

[56] References Cited

U.S. PATENT DOCUMENTS

| | | | |
|---|---|---|---|
| 2,798,213 | 7/1957 | Rowell | 340/213 |
| 3,266,026 | 8/1966 | Plambeck | 340/228 |
| 3,267,300 | 8/1966 | Plambeck | 307/117 |
| 3,437,884 | 4/1969 | Mandock et al. | 317/148.5 |
| 3,852,606 | 12/1974 | Kabat | 250/551 |
| 4,280,184 | 7/1981 | Weiner et al. | 364/506 |
| 4,540,886 | 9/1985 | Bryant | 250/554 |
| 4,591,725 | 5/1986 | Bryant | 250/554 |
| 4,742,236 | 5/1988 | Kawakami et al. | 250/554 |
| 4,750,142 | 6/1988 | Akiba et al. | 364/550 |
| 4,778,378 | 10/1988 | Dolnick et al. | 431/79 |
| 4,983,853 | 1/1991 | Davall et al. | 250/554 |

*Primary Examiner*—Carroll B. Dority
*Attorney, Agent, or Firm*—Wood, Phillips, VanSanten, Hoffman & Ertel

[57] ABSTRACT

A multi-stage, fail-safe fuel control circuit monitors a flame which emits photons and is supplied with fuel through a valve to a burner. The fuel control circuit includes a flame scanner adjacent the valve for generating a count signal including pulses provided at a rate proportional to the energy of the flame adjacent the burner. A timer provides at least one timing signal which periodically shifts between a first and second state. A capacitive pulse-height discriminator is coupled to the flame scanner and to the timer and measures the rate of the pulses in the count signal during the first state of the timing signal and generates a discriminator signal if the pulses exceed a desired rate during the first state. A capacitor discharge oscillator is coupled to the frequency discriminator and the timer charges a capacitor during the first state and provides an oscillating signal powered by the capacitor at a first frequency if the count discriminator signal is generated during the first state. A flame relay is coupled to the amplifier and controls the valve. The flame relay closes the valve if stage a) does not generate the count signal, if stage b) does not generate the timing signal, if stage c) does not generate the discriminator signal, if stage d) does not generate the oscillating signal, and if stage e) does not generate the maintaining voltage.

12 Claims, 3 Drawing Sheets

2N6027
TIP31A
30K
47K
1K
22K
10K
680
11μ
100μ
470μ
8.2V
137V
10
100K

CR
FR
36
FR
10K
366
362
360
364
CR
CR
10K
340
358
32
352
15K
413
412
414
416
418
420
426
430
47K
424
422
452
47K
150K
402
410
400
406
404
440
10M
390
1M
0.1μ
396
0.1μ
388
1M
394
384
385
392
0.47μ
154
383
382
1M
HIGH POWER
NPN
1K
1K
2.2KWW
10K
470K
356
374
376
47K
296
350
372
370
446
450
444
442
448
10K
10k

FUEL CONTROL CIRCUIT

FIELD OF THE INVENTION

The present invention relates to a fuel control circuit for monitoring a flame, and more particularly to a multi-stage fail-safe flame detector for boilers, furnaces, incinerators, etc.

BACKGROUND OF THE INVENTION

Numerous circuits have been proposed for monitoring burner flames to prevent fuel from being delivered after the flame has been extinguished. The prior art devices typically lack true fail-safe design or do not respond quickly to circuit component failures.

When components in these devices fail, fuel can be delivered in the absence of a flame causing a build-up of fuel which could explode.

SUMMARY OF THE INVENTION

A multi-stage, fail-safe fuel control circuit monitors a flame which emits photons and is supplied with fuel through a valve to a burner. The fuel control circuit includes a flame scanner adjacent the valve for generating a count signal including pulses provided at a rate proportional to the energy of the flame adjacent the burner. A timer provides at least one timing signal which periodically shifts between a first and second state. A capacitive pulse-height discriminator is coupled to the flame scanner and to the timer and measures the rate of the pulses in the count signal during the first state of the timing signal and generates a discriminator signal if the pulses exceed a desired rate during the first state. A capacitor discharge oscillator is coupled to the frequency discriminator and the timer charges a capacitor during the first state and provides an oscillating signal powered by the capacitor at a first frequency if the count discriminator signal is generated during the first state. A flame relay is coupled to the amplifier and controls the valve. The flame relay closes the valve if stage a) does not generate the count signal, if stage b) does not generate the timing signal, if stage c) does not generate the discriminator signal, if stage d) does not generate the oscillating signal, and if stage e) does not generate the maintaining voltage.

Other objects and features of the invention will be readily apparent from the specification taken in view of the drawings.

BRIEF DESCRIPTION OF THE DRAWINGS

FIG. 3 in a diagram showing connection of circuit portions of FIGS. 2A and 2B.

DETAILED DESCRIPTION OF THE PREFERRED EMBODIMENT

Figure 1:
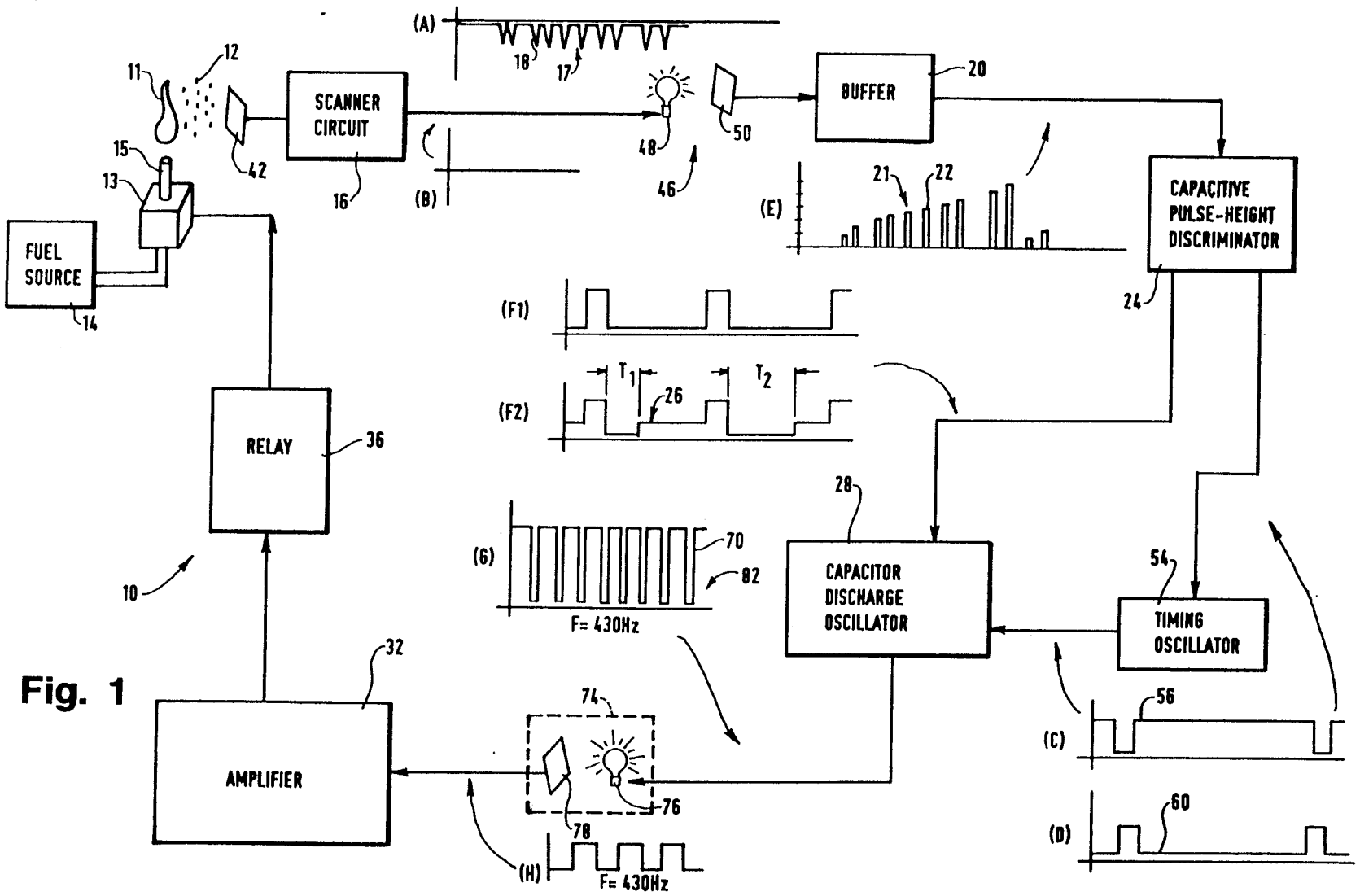
FIG. 1 is a functional block diagram of a fuel control circuit.

FIG. 1 shows a block diagram of a fuel control circuit or detector 10 including six stages for monitoring a flame 11 emitting photons 12. The photons 12 are minute energy packets of electromagnetic radiation which are emitted during the transmission of light from the flame 11. The energy of a photon is directly proportional to the frequency of radiation, in this case ultraviolet (UV) radiation. So long as the flame 11 is present, the detector 10 produces a signal which holds open a valve

13 which delivers fuel from a source 14 to a burner 15 as will be described in detail below.

If the flame 11 is not present or if any stage of the detector 10 fails, the valve 13 is closed to prevent the escape of fuel. The following description briefly describes the interaction between the stages of the detector 10. If any of the conditions or signals described below are not met or generated, the detector 10 closes the valve 13.

Briefly, in the first stage, the flame 11 is monitored by a scanner circuit 16 which produces a raw count signal 17 including spikes 18, as shown in waveform (A), provided at a rate proportional to the (UV) energy adjacent the flame 11. In a second stage, a buffer 20 sharpens and amplifies the raw count signal 17 from the scanner circuit 16 and provides a buffered count signal 21 including pulses 22 having the same rate as the raw count signal 17. The amplitude of the buffered count signal 21 increases until the buffer 20 is reset by a third stage. In a third stage, a capacitive pulse-height discriminator 24 determines if a flame is present by counting the pulses 22 in the buffered count signal during a given period and providing a pulse output 26 to a fourth stage if the pulses 22 exceed a desired count representing the presence of the flame 11. In the fourth stage, a capacitor discharge oscillator (CDO) 28 charges a capacitor. If the CDO 28 receives the pulse output 26 from the capacitive pulse-height discriminator 24 while the capacitor is charged, the capacitor in the CDO 28 discharges to power a 430 Hz oscillating signal 70 (waveform (G)). In a fifth stage, an amplifier 32 resonates if the 430 Hz oscillating signal 70 is provided by the CDO 28. When the amplifier 32 resonates, the amplifier 32 provides an output at a maintaining voltage. If the amplifier 32 does not resonate, the output of the amplifier 32 is a voltage less than the maintaining voltage. In the sixth stage, a relay 36 holds a valve in an open position if the output from the amplifier 32 is at the maintaining voltage and the relay 36 drops out and closes the valve 13 if the output of the amplifier 32 is a voltage less than the maintaining voltage. With the valve 13 in the open position, fuel from the fuel source 14 flows through the valve 13 and burner 15, and the flame 11 will continue to burn fuel and emit photons 12 which are detected by the scanner circuit 16 (the first stage).

More specifically, in the first stage, the flame 11 is fed by fuel from the fuel supply 14 flowing through the valve 13 controlled by the relay 36 to the burner 15. The photons 12 emitted by the flame 11 impinge upon a scanner electrode 42 which is coupled to the scanner circuit 16. If the flame 11 is present, the scanner circuit 16 generates the raw count signal 17 including the negative spikes 18, as shown in waveform (A), at a rate dependent on the energy of the flame 11. The raw count signal 17 generated by the scanner circuit 16 is input to an optocoupler 46 which includes a light-emitting diode (LED) 48 and a phototransistor 50. The LED 48 is illuminated for the duration of each spike 18. If the flame 11 is not present, the scanner circuit 16 has no output, as shown in waveform (B), and does not illuminate LED 48.

The optocoupler 46 couples the raw count signal 17 from the scanner circuit 16 to the buffer 20, the second stage of the detector 10, and isolates the scanner circuit 16 from the buffer 20. The buffer 20 sharpens and amplifies the raw count signal 17 from the scanner circuit 16 and provides the buffered count signal 21 at the same rate as the raw count signal 18 from the scanner circuit 16. The buffered count signal 21 from the buffer 20, illustrated by waveform (E), is input to the pulse-height discriminator 24, the third stage of the detector 10. The pulses 22 in the buffered count signal 21 increase in magnitude as they charge a capacitor (described below in conjunction with FIG. 2) in the pulse-height discriminator 24.

A timing oscillator 54 provides a first timing signal 56, illustrated by waveform (C), and a second timing signal 60, illustrated by waveform (D). The first and second timing signals 56,60, respectively, have a duty cycle of about 90 to 10%, are approximately inverse waveforms, and provide timing for the detector circuit 10.

The second signal 60 from the timing oscillator 54 is connected to the pulse-height discriminator 24. When the second signal 60 is in a low state, the pulse-height discriminator 24 begins counting pulses 22 from the buffer 20. If the pulse-height discriminator 24 counts ten pulses 22 per second (a desired rate) or more before the second signal 60 goes to a high state, the count discriminator 24 outputs a pulse 26 to the CDO 28, as shown in waveform (F1 and F2; described further below). If the desired rate is not reached, the pulse-height discriminator 24 will continue to count pulses 22 from the buffer 20 until either the desired rate is reached or the second signal 60 goes high. When the second signal 60 goes high, the pulse-height discriminator 24 is reset until the second signal 60 goes low.

The pulse output 26 from the pulse-height discriminator 24, shown in waveform (F2), is applied to an input of the CDO 28, the fourth stage of the detector 10. The first signal 56 from the timing oscillator 54 is connected to an input of the CDO 28. When the first signal 56 is in a high state, the CDO 28 charges a capacitor (described and shown in conjunction with FIG. 2). If the CDO 28 receives the pulse 26 from the pulse-height discriminator 24 before the first signal 56 goes to a low state, the CDO 28 provides an oscillating signal 70, illustrated by waveform (G), at 430 Hertz. The CDO 28 uses the charge stored in the capacitor (shown and described in FIG. 2) to power the oscillating signal 70. However, if the first signal 56 goes low before the CDO 28 receives the pulse 26, the CDO 28 is unable to discharge the capacitor.

The oscillating signal 70 of the CDO 28 is connected to an optocoupler 74 including a light-emitting diode (LED) 76 and a photo-transistor 78 adjacent the LED 76. The LED 76 is illuminated when the oscillating signal 70 goes above a threshold 82 in waveform (G). The optocoupler 74 outputs a square wave, as shown in waveform (H), with a frequency defined by the signal 70.

The output of the optocoupler 74 (waveform (H)) is connected to the amplifier 32, the fifth stage of the detector 10. If the frequency of the output of the optocoupler 74 (waveform (H)) is 430 Hz, the amplifier 32 will resonate and provide an output at a maintaining voltage to the relay 36 the sixth stage). If the optocoupler 74 output (waveform (H)) is not at 430 Hz, the amplifier 32 will not resonate and will provide a voltage below the maintaining voltage required by the relay 36 causing the relay 36 to close the valve 13, cutting off gas from the supply 14 to the flame 12.

Figures 2, 2A, 2B:
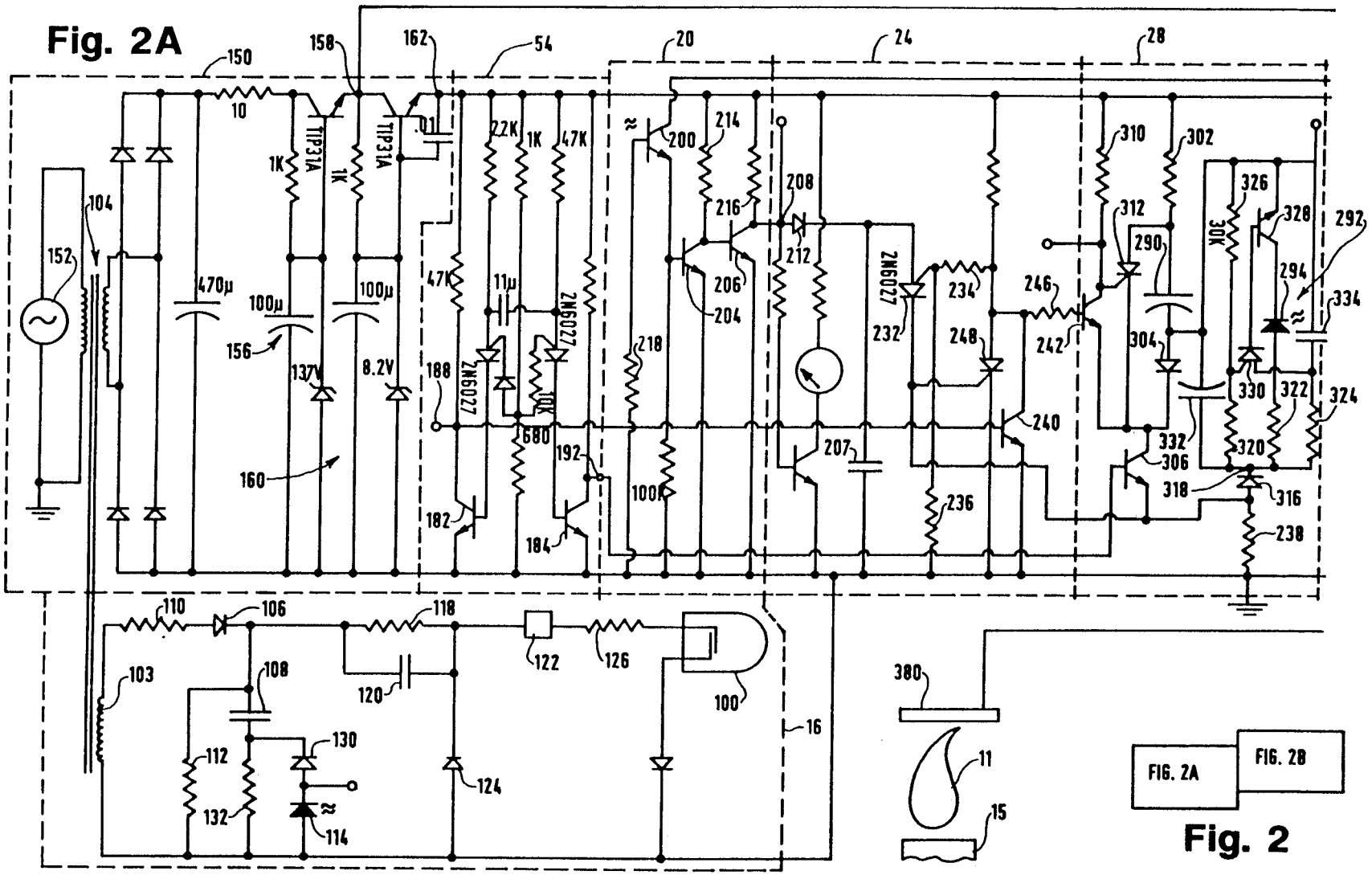
FIGS. 2A and 2B are schematics of the fuel control circuit.
Figure 2B:
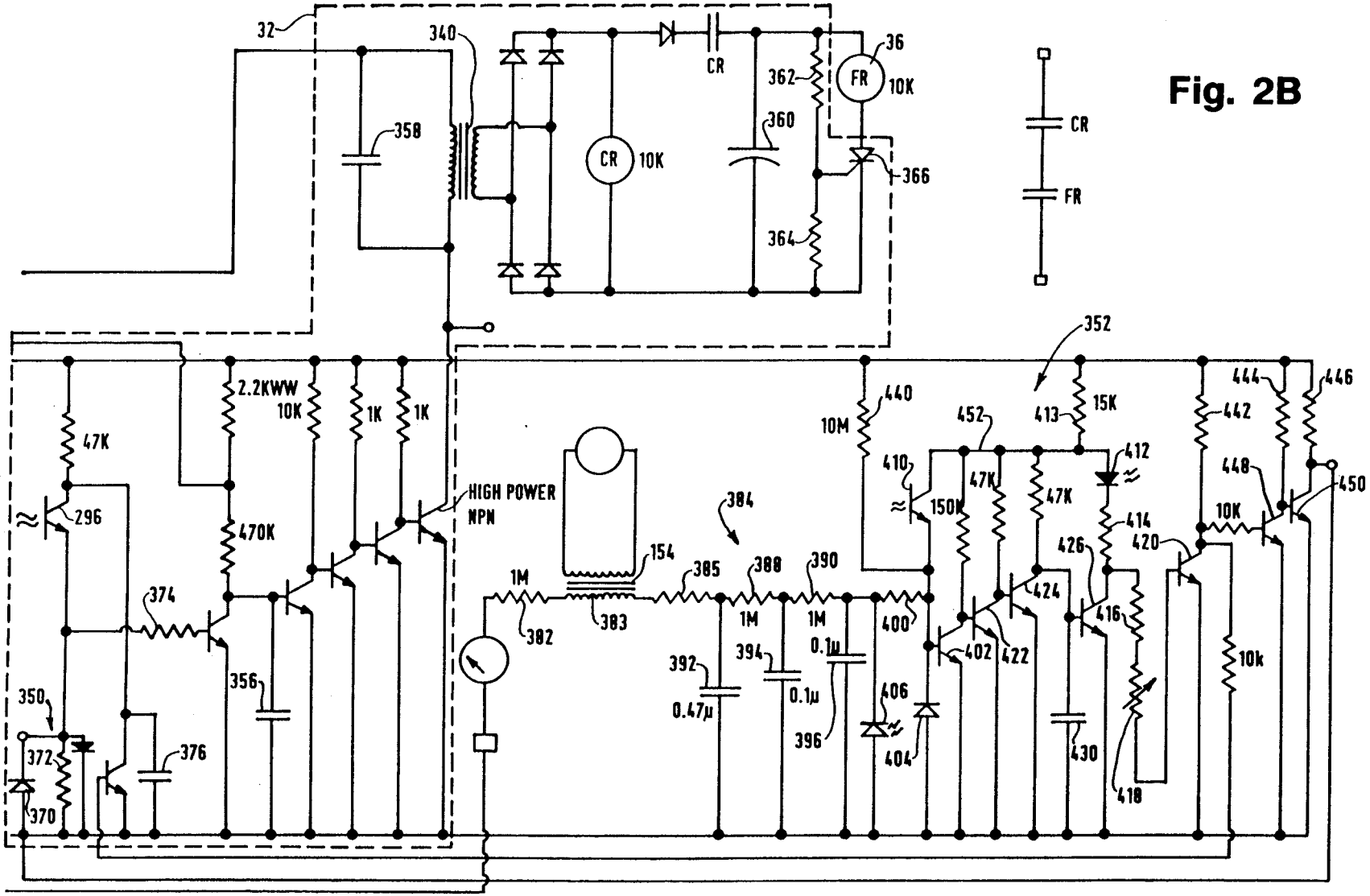

As can be appreciated, the detector circuit 10 exhibits a fail-safe characteristic on a stage-to-stage level as well as on an element-to-element level (as described below in conjunction with FIG. 2). Specifically, each stage of the detector 10 requires a signal from the preceding stage before providing a signal to a subsequent stage. If any stage fails to provide a correct signal to a subsequent stage, or receive the correct signal from a preceding stage, the amplifier 32 will fail to provide the maintaining voltage to the relay 36 to keep the valve 13 open.

Each of the stages, will be described in further detail in conjunction with FIGS. 2A and 2B.

Scanner Circuit

The flame 11 emits the photons 12 which have energy proportional to the wavelength of the light emitted by the flame 11. The scanner circuit 16 includes a UV tube 100 which is placed adjacent the flame 11. The UV tube 100 has a cathode made of a flat conductive plate and an anode made of a conductive wire. This type of UV tube 100 is generally available and approximately ten times more sensitive than a standard UV tube with both the anode and cathode made of conductive wire. The UV tube 100 is tuned to a wavelength of light to be emitted by the flame 11. When the photons 12 from the flame 11 impinge upon the UV tube 100 and a voltage is applied to the UV tube 100, the UV tube avalanches and becomes conductive.

Voltage (310 VAC) is supplied to the UV tube 100 via a winding 103 of a transformer 104, rectified by a diode 106 and stored in a 1 mf capacitor 108. A 100 ohm resistor 110 limits current surge to the capacitor 108. A 1 kohm resistor 132 in series with the charging circuit (including the diode 106, the capacitor 108 and the resistor 110) develops a signal across a light emitting diode (LED) 114. A parallel combination of a 470 kohm resistor 118 and a 0.002 mf capacitor 120 supply DC power to a sensing terminal 122. A zener diode 124 limits the DC voltage applied to the sensing terminal 122 to 350 VDC.

The UV tube 100 includes two electrodes in a tube containing a gas. The characteristics of the UV tube 100 are dependent upon the metal used for the electrodes and the gas used in the tube. When the photon 12 from the flame 11 strikes the electrodes in the UV tube 100, the UV tube 100 begins conducting. A voltage divider defined by the resistor 118, a 1 kohm resistor 126, and the now-conducting UV tube 100 lowers the voltage across the UV tube 100 below its operating voltage. As soon as the UV tube drops below its operating voltage, the electrodes of the UV tube 100 become non-conducting. The conducting/non-conducting cycle of the UV tube 100 results in a pulse discharge across the LED 114. The frequency of the conducting/non-conducting cycling of the UV tube 100 is governed by the energy of the photons adjacent the electrodes of the UV tube 100 and the time necessary to charge/discharge the capacitor 120. Using the values for the circuit elements shown in FIG. 2 will produce a maximum frequency of approximately 2000 Hz. The waveform (A) in FIG. 1 is idealized and does not show the effects of noise associated with the changing/discharging of the capacitor 108.

Pulse currents (related to voltage spikes 18) flowing when the UV tube 100 is conducting flow from the capacitor 108 through the resistor 118, the capacitor 120, the resistor 126, the UV tube 100, ground, the LED 114, a diode 130, a resistor 132 and the capacitor 108. Current flowing through the LED 114 illuminates the LED 114 for the duration of the spike 18 in waveform (A) of FIG. 1. The LED 114 is optically coupled to the buffer 20 as described above in conjunction with FIG. 1.

The resistor 112 discharges the capacitor 108 when the winding 104 is de-energized to prevent electrical shock to an operator. The resistor 126 limits a discharge current through the UV tube 100 due to energy stored in the capacitance of an extension wire between an actual location of the UV tube 100 and a remainder of the scanner circuit 16.

Table I summarizes the fail-safe operation of components in the scanner circuit:

TABLE I

| Component | Component shorted | Component Open |
|---|---|---|
| Resistor 110 | Capacitor 108 stressed-may fall open or shut | no power-no output |
| Resistor 112 | Capacitor 108 shorted-no output | Capacitor 108 cannot discharge when power is removed |
| | phototransistor 200 driven into saturation; amplifier 32 driven out of resonance. | No power - no output |
| Capacitor 108 | | No power - no output |
| Resistor 132 | LED 114, Diode 130 Shunted-no output | Capacitor 108 cannot charge, circuit broken-no output |
| Resistor 118 | Current to UV tube 100 excessive, UV tube 100 will lock on-no pulses, LED 114 remain constantly illuminated. Since circuit counts pulses only-no final output | Capacitor 120 only supplying power to tube-insufficient operation power no output |
| Capacitor 120 | Same as resistor 118 | Frequency of UV tube 100 becomes extremely high (several megacycles) LED 114 constantly illuminated Since circuit counts pulses only - no final output. |
| Zener diode | No UV tube 100 power pulses possible no output | Voltage regulation lost. Voltage to UV tube 100 will vary with line voltage. No change in operation. |
| UV tube 100 | same as Zener diode 124 | Does not apply. |

UV Tube 100: If tube should become damaged due to leaks or internal contaminates or due to internal out gasing, the operating voltage of the tube can change. If the blocking voltage of the tube should fall within the operating voltage of the tube, the frequency of the pulses becomes extremely high. No output. See Capacitor 120 open.

Power Supply

A power supply 150 includes a 117 VAC, 60 HZ source 152 coupled to the transformer 104. A series pass regulator 156 provides a fixed voltage VH of 13.1 VDC at a terminal 158. Another series pass regulator 160 provides a fixed voltage VL at 7.5 VDC at a terminal 162.

Timing Oscillator

A timing oscillator 54 is connected to the terminal 162 of the power supply 150. The timing oscillator 54 is a programmable unijunction controlled asymmetrical relaxation oscillator having a duty cycle of approximately 90% to 10%. The timing oscillator 54 controls output transistors 182, 184 alternately at a frequency of approximately 3.5 HZ.

The transistor 182 provides the second timing signal 60 at a terminal 188 to the pulse-height discriminator 24 which measures the rate of pulses 22 from the scanner circuit 16. When the timing signal 60 is high, the pulse-height discriminator 24 is reset and when it is low, the pulse-height discriminator 24 is measuring the rate of the pulses 22, as described in greater detail below in conjunction with the pulse-height discriminator 24.

The transistor 184 provides the first timing signal 56 (at node 192) which is approximately an inverse wave form of the timing signal 60. The timing signal 56 from the transistor 184 provides timing for the CDO 28. Power capacitor 290 in the CDO 28 is charging when the first timing signal 56 is high and not charging when the first timing signal 56 is low. Circuits driving the transistors 182, 184 must be run in an off-on, on-off manner to provide sufficient power to allow the CDO 28 to oscillate.

The timing oscillator 54 is inherently fail-safe. An open or short circuit of any of the passive components or semi-conductors will stop oscillation. Likewise, an open or short circuit of any of the semiconductor junctions will stop oscillation. Without oscillation, neither the CDO 28 nor the pulse-height discriminator 24 will operate and the entire detector circuit 10 ceases operation causing the valve 13 to close and cut off fuel to the burner 15.

Buffer

The buffer 20 is a direct coupled TTL amplifier which is powered by the VL terminal 162 of the power supply 150. The buffer 20 includes a phototransistor 200 which is optically coupled to the LED 114 in the scanner circuit 16. The phototransistor 200 is directly coupled to transistors 204, 206. The buffer 20 isolates, sharpens and amplifies the spikes 18 in the raw count signal 17 from the scanner circuit 16 and generates the buffered count signal 21. As a phototransistor 200 switches on and off due to the spikes 18 across the optically coupled LED 114, the transistors 204, 206 reverse states and bias a node 208 alternately at ground and VL.

The buffered count signal 21 increases in magnitude due to a charge buildup on a 0.1 microfarad capacitor 207 in the pulse-height discriminator 24 through a diode 212. The diode 212 prevents the capacitor 207 from discharging through the transistor 206 when the transistor 206 is conducting.

Since the pulse-height discriminator 24 can only operate when the buffer 20 provides pulses 22 thereto, the buffer 20 is inherently fail-safe. A failure (short or open circuit) of a 470 kohm resistor 214, a 6.8 kohm resistor 216, the transistor 204 or the transistor 206 will drive the transistor 206 of the buffer 20 into either a conducting or non-conducting state and the buffer 20 will remain in the state. If the transistor 200 is a short circuit, node 208 is biased to ground by transistor 206. Capacitor 207 is deprived of operating power and the capacitive pulse-height discriminator 24 ceases operation.

A 10 Mohm resistor 218 provides an off bias for the phototransistor the resistor 218 is a short circuit, buffer 20 has no output. If the resistor 218 is an open circuit, the speed and sharpness of the buffered count signal 21 is adversely affected. While this condition will not necessarily stop the detector circuit 10 immediately, the condition will cause shutdown if the pulses 22 in the buffered count signal 21 are insufficient to charge the capacitor 207 in the pulse-height discriminator 24, as described below.

Pulse-Height Discriminator

The capacitive pulse-height discriminator 24 can best be described as a simple self-powered frequency to voltage converter with latch memory and external reset by the timing oscillator 54. Input pulses 22 are provided by the buffer 20 through the diode 212. The capacitor 207 is charged through the resistor 216, and the diode 212 prevents the capacitor 207 from discharging as the buffer 20 switches between VL and ground. An RC time constant of the resistor 216 and the capacitor 207 is chosen such that approximately 10 pulses/second are required to charge the capacitor 207 to a firing voltage of a programmable unijunction transistor (PUT) 232. The firing voltage of the PUT 232 is set by a voltage divider consisting of a 150 kohm resistor 234 and a 100 kohm resistor 236. In the circuit of FIG. 2, the PUT 232 fires at approximately 2.5 VDC and discharges through a 33 ohm resistor 238 common to the pulse-height discriminator 24 and the CDO 28. Energy stored on the capacitor 207 is used to derive the pulse output 26 to the CDO 28.

When the first timing signal 56 is high and the second timing signal 60 is low and input pulses are provided by the buffer 20 through the diode 212, the capacitor 207 is charged by VL through the resistor 216. In the absence of the buffered count signal 21 from the buffer 20, the pulse-height discriminator 24 provides the waveform (F1) to the CDO 28. When the first timing signal 56 is high, the transistor 240 is not conducting, the transistor 242 is conducting and the waveform (F1) (See FIG. 1) is high. When the first timing signal goes low, the transistors 240, 242 reverse states. Note, under these conditions, the transistor 242 and a transistor 306 (see CDO 28 description below) operate in unison.

When the buffered count signal is present, the output of the pulse-height discriminator 28 changes to waveform (F2) (See FIG. 1). A period T1 in waveform (F2) of FIG. 1 represents a length of time to charge the capacitor 207 with approximately 10 pulses/second (desired rate). Note that the length of time required to charge the capacitor 207 varies (e.g. T2>T1) dependant upon the ultra-violet energy adjacent the flame 11. In practice, however the charge periods T1 and T2 will be approximately equal.

Note that when transistor 240 is not conducting (timing signal 56 high) and the buffered count signal 21 is at the desired rate, the SCR 248 is fired. The transistor 242 is turned off and an SCR 312 (see CDO 28 description below) is turned on. The output of the pulse-height discriminator 24 is referenced to ground through a G to K junction of the SCR 312, the transistor 306, and the resistor 238. A forward voltage drop across the resistors and semiconductor junctions give a rise in voltage at 26 in waveform (F2).

If the capacitor 207 is charged with approximately 10 pulses/second (desired rate) while the timing signal 56 is high, the PUT 232 will fire. A silicon controlled rectifier (SCR) 248 is turned on by the PUT 232 and latches in a conducting state. The SCR 248 biases a base of the transistor 242 to ground turning the transistor 242 off. If the transistor 242 goes from a conducting state to a non-conducting state while the timing signal 56 is high, the CDO 28 will provide an oscillating signal 70.

If the capacitor 207 is not charged by 10 pulses/-second from the buffer 20 until after the timing signal 56 goes low, the CDO 28 will not provide the oscillating signal 70 and valve 13 will close shutting off fuel.

The fail-safe characteristics of the pulse-height discriminator 24 is summarized below in Table II:

TABLE II

| Component | Component shorted | Component Open |
|---|---|---|
| Diode 212 | Capcitor 207 charges and discharges with operation of transistor 206. Capacitor 207 cannot obtain sufficient charge to fire PUT 232. | no power to Capacitor 207-no output |
| Capacitor 207 | PUT 232 shunted out-no output | Insufficient power to drive PUT 232-no output |
| PUT 232 | Capacitor 207 shunted to ground by resistor 238-no energy to drive SCR 248 - no output | No power to SCR 248 - no output |
| Resistor 234 | PUT 232 biased to Capacitor 207 cannot charge to VL - therefore no output to SCR 242-no output | PUT 232 biased to ground. PUT 232 fires on any pulse, however insufficient charge on Capacitor 207 to power SCR no output |
| Resistor 236 | PUT 232 referenced to ground. See resistor 234 open | PUT 232 biased to VL. See resistor 234 shorted |
| Resistor 244 | VL shorted. No power in CDO 28 - no further output | No power available to drive, transistor 242-output to CDO 28 high. |
| SCR 248 | Output of CDO 28 high. No power in CDO 28 - no further output | Timing oscillator 54 outputs prevent CDO 28 from changing-no further output |
| Transistor 240 | Output of CDO 28 high. No power in CDO 28 - no further output | SCR 248 does not reset-no further output |
| Resistor 310 | Combined with SCR 312 and transistor 306, VL pulled to ground-no output | No power to transistor 242-no output |
| Resistor 238 | No output to SCR 248 from PUT 232-no output | Capacitor 290 tries to charge through transistor 306 and SCR 248. SCR 248 conducts, turning on SCR 312 which discharges capacitor 290. No power on capacitor 290, no power for relaxation oscillator 292. |

Capacitor Discharge Oscillator

The CDO 28 derives operational power solely from a 100 mf capacitor 290 that is charged while the pulse-height discriminator 24 is counting, i.e. when the timing signal 56 is high and the firing voltage of the PUT 232 has not been reached. By using the energy stored in the capacitor 290, the CDO 28 is divorced from the power supply 150. Furthermore, without proper timing from the timing oscillator 54, the capacitor 290 will either not charge or be unable to discharge.

The CDO 28 includes a relaxation oscillator 292 which drives a light emitting diode (LED) 294 which is optically coupled to a phototransistor 296 in the amplifier 32. When the timing signal 56 is high (timing signal 60 is low), the capacitor 290 is charged through a 470 ohm resistor 302, a diode 304, a transistor 306 (conducting) and a resistor 238. The relaxation oscillator 292 and the LED 294 are normally reverse biased with respect to the power supply to enhance the fail-safe characteristics of this stage.

If the transistor 242 is in the conducting state when the timing signal 56 is high and the PUT 232 is fired (conditions required to produce the discriminator signal), a 47 kohm resistor 310 biased by VL drives a SCR 312 into conduction and latches the SCR 312 through the resistor 302, the transistor 306, nd the resistor 238. Concurrently, a discharge path is provided for the capacitor 290 through the SCR 312, the transistor 306, a diode 316 and the relaxation oscillator 292. Because a common node 318 of the relaxation oscillator 292 (consisting of a 10 kohm resistor 320; a 4.7 kohm resistor 322; a 100 kohm resistor 324; a 30 kohm resistor 326; a transistor 328; a PUT 330; a 100 mf capacitor 332; and a 0.02 microfarad capacitor 334) and the LED 294 are connected to a negative electrode of the capacitor 290, the relation oscillator 292 is now forward based and will begin oscillation at 430 Hz. The frequency of oscillation is set by circuit components of the relaxation oscillator 292 mentioned above. The SCR 312 will remain on until the transistor 306 turns off (timing signal 56 goes low).

When the transistor 306 is conducting, the transistor 242 is also conducting because the transistor 240 is not conducting (Note: transistor 240 and transistor 306 are reciprocals, e.g. when one is conducting, the other is not conducting. The timing oscillator 54 directly controls the transistors 242, 306).

When the transistor 306 is conducting, the transistor 242 shunts out a G to K junction of the SCR 312 to hold the SCR 312 in a non-conducting state. As a result, the capacitor 290 cannot discharge through the SCR 312.

If the buffer 20 does not provide the buffered count signal 21 or if the desired count is not reached (no CDO 28 output) before the timing signal 56 goes low, the transistor 306 turns off and the transistor 240 turns on. The transistor 240 shunts the base of the transistor 242 to ground turning the transistor 242 off. The gate of the SCR 312 is forward biased. However since the transistor 306 is not conducting, the cathode of the SCR 312 cannot conduct. Consequently, the capacitor 290 cannot discharge and remains fully charged. When the transistor 240 and the transistor 306 reverse states when the timing signal 56 goes high, the capacitor 290 is allowed to charge again.

The capacitor 332 in the relaxation oscillator 292 is charged when the relaxation oscillator 292 is forward based (conducting). The transistor 242 is in a non-conducting state when the timing signal 56 is low or when the timing signal 56 is high and the PUT 232 is fired. The charge on the capacitor 332 powers the relation oscillator 292 for approximately 20 ms while the timing signal 56 is low. Without the capacitor 332, the amplifier 32 would be repeatedly shut off causing unnecessary stress on a transformer 340 in the amplifier 32. The resistor 322 and the transistor 328 drive the LED 294 and compensate for variations in a nominal forward bias threshold of the LED 294 which varies with temperature.

If the PUT 232 is not fired until the timing signal 56 goes low, the CDO 28 will not provide the discriminator signal. Because the transistor 306 is reverse-biased when the timing signal 56 is low, the capacitor 290 does not have a discharge path and is unable to power the relaxation oscillator 292. As a result, the amplifier 32 will not resonate and the relay 36 will drop out.

The fail-safe characteristics of the CDO 28 are summarized below in Table III:

TABLE III

| Component | Component shorted | Component Open |
|---|---|---|
| Resistor 246 | Transistor 242 base over driven. Combined with timing signal overlap, and SCR 312 clamp voltage, transistor 242 remains on. SCR 312 cannot trigger-no output. | No input to CDO 28. Nothing in-nothing out. |
| Resistor 310 | SCR 312 biased on continuously, capacitor 290 cannot charge, no operating power to oscillator-no output | No drive for SCR 312-no output |
| SCR 313 | Capacitor 290 cannot charge. No operating power. No output | Capacitor 290 cannot discharge. No operating power for oscillation |
| Resistor 238 | No output to SCR 248 from PUT 232 - no output | Capacitor 290 tries to charge through SCR 248. SCR 248 conducts, turning on SCR 312 which discharges capacitor 290. No power on capacitor 290, no power for relaxation oscillator 292. |
| Capacitor 290 | No power for CDO 28 - no output. | No power for CDO 28 - no output. |
| Capacitor 332 | CDO 28 shorted - no output | Flame relay 36 will drop out on low signals - circuit will still function. |
| Transistor 306 | When SCR 312 fires it latches to VL - No power to capacitor 290 - no further output. | Capacitor 290 cannot charge - no power - no output. |
| Transistor 328 | LED 294 forward biased - no oscillation - output to amplifier 32 - no output. | No drive for LED 294 - no output. |
| Transistor 242 | SCR 312 gate shorted - no input for CDO 28 - no output. | Capacitor 290 tries to charge through transistor 306 and SCR 248. SCR248 fires before Capacitor 290 charges - no power on capacitor 290-no output. |
| Resistor 326 | PUT 330 fires as soon as transistor 306 supplies power. LED 294 forward biased through transistor 328. No oscillation to amplifier 32 - no output. | PUT 330 biased to output of capacitor 290 when transistor 306 is conducting, PUT 330 cannot fire - no output. |
| Resistor 320 | See resistor 326 open. | See resistor 326 shorted. |
| Resistor 324 | PUT 330 fires at rate of timing signals to slow to drive amplifier 32. No output. | No charge on capacitor 334 - no oscillation - no output. |
| PUT 330 | Transistor 328 forward biased with signal - no oscillation - no output. | No drive for transistor 328 - no output from LED 294. |
| Capacitor 334 | PUT 330 cannot fire - no oscillation - no output. | PUT 330 forward biases transistor 328 - no oscillation - no output. |
| Resistor 322 | Oscillation stops - no output. | No power for LED 294 - no output. |
| Diode 316 | Prevents capacitor 332 from discharging into circuit. At high signals (short charge | No power for oscillator- no output. |

TABLE III-continued

| Component | Component shorted | Component Open |
|---|---|---|
| | time for capacitor 290) there is insufficient power to the oscillator - no output. At low microamp signals (long charge time for capacitor 290) flame relay 36 will pull in and then drop out. | |

Amplifier Circuit

The amplifier circuit 32 is a direct coupled TTL amplifier powered by VH and VL from the power supply 150. The amplifier circuit 32 includes an input 350 from a flame rod circuit 352 (described in detail below) and an input from the CDO 28. The amplifier circuit 32 includes the phototransistor 296 which is light-coupled to the LED 294 in the CDO 28.

Both the flame rod circuit 352 and the CDO 28 are designed to produce a 430 Hz input frequency to the amplifier circuit 32. The amplifier circuit 32 is tuned to resonate at 430 Hz by a 0.033 mf capacitor 356 and a 1 microfarad capacitor 358. Without resonation, there is insufficient power to energize or maintain the relay 36. When current from the amplifier 32 resonates, there is sufficient power to maintain the relay 36.

Energizing the relay 36 is accomplished by the rectified output of the transformer 340, a 15 microfarad capacitor 360, a 150 kohm resistor 362, a 1 kohm resistor 364, and a SCR 366. With the transformer 340 resonating at 430 Hz, VH from the power supply 150 is converted to 430 Hz by the amplifier circuit 32 and the transformer 340. The capacitor 360 charges to the full resonant voltage of the power supply 150 (approximately 125 VDC) at no load conditions. If this voltage was applied directly to a coil of relay 36, the load of the relay 36 would keep the voltage from rising above approximately 50 VDC which is below the energize voltage (approximately 75 VDC). To obtain the energize voltage, energy is stored on the capacitor 360 until the resistor 364 is biased to 0.7 V by a voltage divider composed of the resistors 362, 364. The bias on the resistor 364 turns the SCR 366 on and discharges the energy stored on the capacitor 360 through the coil of the relay 36 and the SCR 366 causing the relay 36 to latch. The increased load of the relay 36 drops the voltage across the relay 36 below the energize voltage and above a minimum voltage required to maintain the relay 36. If the voltage across the relay 36 drops below the minimum voltage required to maintain the relay, the relay will drop out and close the valve 13.

While the amplifier 32 can obtain sufficient power to energize the relay 36, it cannot do so without an ignition circuit, for example a Protection Controls Primary Combustion Safeguard. The amplifier 32 requires that the transformer 340 resonate at 430 Hz to obtain sufficient energy to provide the energize voltage. However, the amplifier cannot resonate absent the oscillating signal 70 from the CDO 28 or from the flame rod circuit 352.

In other words, the flame 11 must be ignited and remain ignited for several seconds to allow either the flame rod circuit 352 to generate a flame rod signal (described below) or the CDO 28 to generate the oscillating signal 70. A typical ignition circuit includes an operating sequence in which a push button is depressed and held. The push button opens a pilot valve and energizes an ignition system which ignites a pilot flame. Several seconds later, either the CDO 28 generates the oscillating signal 70 or flame rod circuit generates the flame rod signal. The relay 36 is energized as described above and the push button is released.

The operation of the amplifier circuit 32 is inherently fail-safe with the exception of a diode 370, a 100 kohm resistor 372, a 100 kohm resistor 374, and a 0.47 microfarad capacitor 376. If the resistor 372 and the capacitor 376 are short circuits or the resistor 372 and the resistor 374 are open circuits, the detector 10 will shut down. If the resistor 374 is a short circuit or the capacitor 376 is an open circuits, the detector 10 will function, however input sensitivity will be increased causing more nuisance shut-downs. If the diode 370 is an open circuit, the flame rod circuit 352 will be disabled. If the diode 370 is shorted, the CDO 28 will be unable to produce the oscillating output 70.

Flame Rod Circuit

The flame rod circuit 352 is a tuned TTL amplifier with optical biasing and feedback. A high AC voltage biases a probe 380 placed in the flame 11. By the flame rectification principal, a small direct current flows through the ionized flame 11 (analogous to the operation of a vacuum tube diode). The small direct current flows across a 1 Mohm resistor 382, a winding 383 of the transformer 154, and a multi-stage $\pi$ filter 384 (including a 470 kohm resistor 385: a 1 Mohm resistor 388; a 1 Mohm resistor 90; and a 0.47 microfarad capacitor 392; a 0.1 microfarad capacitor 394; and a 0.1 microfarad capacitor 396). The values of the resistors 382, 385, 388, 390 and the capacitors 392, 394, 396 are chosen to provide a short RC time constant (short charging time), and to provide a high resistance to the probe 380 to limit current in case an operator accidentally touches the probe 380.

The impedance of the flame 11 is very high (several megohms or higher) and the flame 11 is conductive only when gases are burned,(ionized). When the probe 380 is inserted in the flame 11, electron flow from the burner 15 to the probe 380 charges the capacitors 392, 394, 396 negatively to ground. The negative voltage on the capacitors 392, 394, 396 is fed through a 1 Mohm resistor 400 to a transistor 402. A diode 404 protects a base-emitter junction of the transistor 402 in the event the probe is shorted to ground. A light emitting diode 406 prevents large current from excessively reverse biasing the transistor 402 and halting operation of the flame rod circuit 352. When the probe 380 is not in the flame 11, the transistor 402 is normally conducting due to a forward bias provided by phototransistor 410 which is conducting. The phototransistor 410 is optically coupled to a LED 412 which is slightly forward biased by a 15 kohm resistor 413, a 22 kohm resistor 414, a·47 kohm resistor 416, and a 200 kohm variable resistor 418 in series with a base-emitter junction of a transistor 420.

With the probe 380 not in the flame 11, a positive charge accumulates on the capacitors 392, 394, 396 due to voltage applied through the resistor 413, the phototransistor 410 and the resistor 400 and through a 10 Mohm resistor 440 and the resistor 400. The positive charge on the capacitors 392, 394, 396 forward bias the transistor 402 turning it on.

When the transistor 402 turns off due to the negative charge developed on the capacitors 392, 394, 396 when the probe 380 is in the flame 11, transistors 422, 424 and 426 reverse states. When the transistor 426 turns on, the forward bias on the transistor 402 increases due to the transistor 426 driving the LED 412 through the resistor 414. The higher forward bias turns the transistor 402 back on which turns the transistor 426 back off and the circuit oscillates at about 2 kHz. A capacitor 430 slows the oscillation and provides a flame rod signal at 430 Hz (not shown) to the amplifier 32 similar to the oscillating signal 70 from the CDO 28.

The remainder of the flame rod circuit 352 consisting of resistors 442 (22 kohm), 444 (10 kohm), 446 (470 kohm) and transistors 420, 448, 450 amplify the signal. The resistor 413 allows a feed bus 452 to have current spikes during oscillation.

A short circuit of the probe 380 injects a large 60 Hz signal which biases the transistor 402 at such a high level that the flame rod circuit 352 will not oscillate. Any pure resistance between a base of the transistor 402 and ground will bias the transistor 402 into saturation and stop oscillation. An open or short circuit of the capacitors 392, 394, 396 has the same effects. The circuit is inherently fail-safe with the exception of resistors 382, 385, 388, 390. These resistors will not stop the detector 10 but will affect input sensitivity and possibly cause the transistor 402 or the photo-transistor 410 to fail which will stop the detector circuit 10 by closing the valve 13.

While specific values have been given for components of the detector 10, modifications will be readily apparent.

What is claimed is:

1. A multi-stage fail-safe fuel control circuit for monitoring a flame supplied through a valve to a burner, the flame emitting photons and having energy, the fuel control circuit including:

a) a flame scanner located adjacent the burner for generating a count signal including pulses provided at a rate proportional to the energy of the flame adjacent the burner;

b) a timer providing a timing signal which periodically shifts between a first and second state;

c) a capacitive pulse-height discriminator coupled to the flame scanner and to the timer, for measuring the rate of the pulses in the count signal during the first state of the timing signal, and for generating a discriminator signal if the pulses exceed a desired rate during the first state;

d) a capacitor discharge oscillator coupled to the pulse-height discriminator and the timer for charging a capacitor during said first state and for providing an oscillating signal powered by the capacitor at a first frequency if the count discriminator signal is generated during the first state;

e) an amplifier coupled to the oscillator and resonating at the first frequency for providing a maintaining voltage when said oscillating signal is at said first frequency and for providing a voltage less than the maintaining voltage when said oscillating signal is not at said first frequency;

a flame relay coupled to said amplifier for controlling said valve, wherein the flame relay closes said valve if stage a) does not generate said count signal, if stage b) does not generate said timing signal, if stage c) does not generate said discriminator signal, if stage d) does not generate said oscillating signal, and if stage e) does not generate said maintaining voltage.

2. The multi-stage, fail-safe fuel control circuit of claim 1 wherein the flame scanner includes an ultraviolet tube having a flat conductive plate cathode and a conductive wire anode and a means connected to said ultraviolet tube for providing a voltage spike across a light emitting diode when said tube avalanches.

3. The multi-stage, fail-safe fuel control circuit of claim 2 wherein the flame scanner includes a buffer means having a phototransistor optically coupled to said light emitting diode for sharpening and amplifying said voltage spikes to provide said pulses in said count signal.

4. The multi-stage, fail-safe fuel control circuit of claim 1 wherein said pulse-height discriminator includes a capacitor which is charged by said pulses of said count signal during the first state of the timer, said capacitor being charged above a threshold voltage if said pulses exceed the desired rate.

5. The multi-stage, fail-safe fuel control circuit of claim 4 wherein said pulse-height discriminator includes a programmable unijunction transistor biased by a voltage divider to fire at the threshold voltage.

6. The multi-stage, fail-safe fuel control circuit of claim 4 wherein said pulse-height discriminator includes a diode which prevents said capacitor from discharging while said pulses charge said capacitor during said first state.

7. The multi-stage, fail-safe fuel control circuit of claim 5 wherein said pulse-height discriminator includes a silicon controlled rectifier which conducts when said programmable unijunction transistor is fired during said first state providing said discriminator signal to said oscillator.

8. The multi-stage, fail-safe fuel control circuit of claim 1 further including a power supply and wherein the capacitor discharge oscillator comprises the capacitor and a relaxation oscillator reverse biased with respect to a power supply of said fuel control circuit and connected to a negative node of said capacitor, said capacitor discharge oscillator including a means for discharging said capacitor through said relaxation oscillator in response to said discriminator signal wherein said discharging capacitor provides power for said oscillating signal.

9. The fuel control circuit of claim 8, wherein said relaxation oscillator includes a light emitting diode which is illuminated by said oscillating signal, and said amplifier includes a phototransistor optically coupled to said light emitting diode.

10. The fuel control circuit of claim 5 further including a power supply and wherein said pulse-height discriminator includes a first silicon controlled rectifier which conducts when said programmable unijunction transistor is fired during the first state of the timer, said capacitor discharge oscillator includes a relaxation oscillator reverse biased with respect to the power supply of said fuel control circuit, a second silicon controlled rectifier and a transistor, said transistor being connected to said first silicon controlled rectifier and said second silicon controlled rectifier and switching from being forward biased to being reverse biased when said first silicon controlled rectifier begins conducting during said first state to cause said second silicon controlled rectifier to conduct and provide a discharge path for the capacitor into said relaxation oscillator, said relaxation oscillator providing said oscillating frequency powered by said discharging capacitor.

11. The fuel control circuit of claim 1 further including a means for igniting said flame and for providing fuel to said flame until said relay is energized, said amplifier including:

a means for amplifying said oscillating signal from said capacitor discharge oscillator;

an energizing capacitor charged by said amplifying means;

a silicon controlled rectifier in series with a coil of said relay;

a voltage divider biasing a gate of said silicon controlled rectifier to turn on said silicon controlled rectifier when said energizing capacitor reaches a full resonant voltage, said capacitor discharging through said coil and said silicon controlled rectifier to energize said relay.

12. A multi-stage fuel-safe fuel control circuit for monitoring a flame supplied through a valve to a burner, the flame emitting photons and having energy, the fuel control circuit including:

a) a flame scanner located adjacent the burner for generating a count signal including pulses provided at a rate proportional to the energy of the flame adjacent the burner;

b) a timer providing a timing signal which periodically shifts between a first and second state;

c) a capacitive pulse-height discriminator coupled to the flame scanner and to the timer, for measuring the rate of the pulses in the count signal during the first state of the timing signal, and for generating a discriminator signal if the pulses exceed a desired rate during the first state;

d) a capacitor discharge oscillator coupled to the pulse-height discriminator and the timer for charging a capacitor during said first state and for providing an oscillating signal powered by the capacitor at a first frequency if the count discriminator signal is generated during the first state;

e) an amplifier coupled to the oscillator and resonating at the first frequency for providing a maintaining voltage when said oscillating signal is at said first frequency and for providing a voltage less than the maintaining voltage when said oscillating signal is not at said first frequency;

f) a flame relay coupled to said amplifier for controlling said valve, a flame rod circuit including a probe inserted in the flame, said flame rod circuit being coupled to said amplifier and providing a flame rod signal which oscillates at said first frequency when said flame is present, said flame rod signal being coupled to said amplifier, said amplifier providing the maintaining voltage when said either flame rod signal is at the first frequency or when said capacitor discharge oscillator provides said oscillating signal at the first frequency and providing a voltage less than said maintaining voltage when neither said flame rod signal nor said oscillating signal is at said first frequency;

wherein the flame relay holds said valve open if either stage f) provides said flame rod signal and stage e) provides said maintaining voltage, or if stage a) provides said count signal, stage b) provides said timing signal, stage c) provides said discriminator signal, stage d) provides said oscillating signal, and stage e) provides said maintaining voltage.

* * * * *